US010077490B2

(12) United States Patent
Valls

(10) Patent No.: US 10,077,490 B2
(45) Date of Patent: Sep. 18, 2018

(54) LOW TEMPERATURE HARDENABLE STEELS WITH EXCELLENT MACHINABILITY

(71) Applicant: VALLS BESITZ GMBH, Berlin (DE)

(72) Inventor: Isaac Valls, Berlin (DE)

(73) Assignee: VALLS BESITZ GMBH, Berlin (DE)

( * ) Notice: Subject to any disclaimer, the term of this patent is extended or adjusted under 35 U.S.C. 154(b) by 291 days.

(21) Appl. No.: 14/399,289

(22) PCT Filed: May 7, 2013

(86) PCT No.: PCT/EP2013/059471
§ 371 (c)(1),
(2) Date: Nov. 6, 2014

(87) PCT Pub. No.: WO2013/167580
PCT Pub. Date: Nov. 14, 2013

(65) Prior Publication Data

US 2015/0118098 A1 Apr. 30, 2015

(30) Foreign Application Priority Data

May 7, 2012 (EP) ..... 12166948

(51) Int. Cl.
*C22C 38/12* (2006.01)
*C22C 38/22* (2006.01)
(Continued)

(52) U.S. Cl.
CPC ..... *C22C 38/58* (2013.01); *C21D 1/30* (2013.01); *C21D 6/002* (2013.01); *C21D 9/00* (2013.01);
(Continued)

(58) Field of Classification Search
None
See application file for complete search history.

(56) References Cited

U.S. PATENT DOCUMENTS 2,147,121 A 2/1939 Emmons
2,715,576 A 8/1955 Payson et al.
(Continued)

FOREIGN PATENT DOCUMENTS

EP 2236639 A1 * 10/2010 ..... C22C 38/44
JP 56-009328 1/1981
(Continued)

OTHER PUBLICATIONS

Machine-English translation of JP 2000-226635, Sera Tomoaki et al., Aug. 15, 2000.*
(Continued)

*Primary Examiner* — Deborah Yee
(74) *Attorney, Agent, or Firm* — Scott R. Cox

(57) ABSTRACT

The present invention relates to the application of at least partially bainitic or interstitial martensitic heat treatments on steels, often tool steels or steels that can be used for tools. The first tranche of the heat treatment implying austenitization is applied so that the steel presents a low enough hardness to allow for advantageous shape modification, often trough machining. Thus a steel product is obtained which can be shaped with ease and whose hardness can be raised to a higher working hardness with a simple heat treatment at low temperature (below austenitization temperature).

20 Claims, 1 Drawing Sheet

(51) Int. Cl.

| | |
|---|---|
| ***C22C 38/44*** | (2006.01) |
| ***C22C 38/58*** | (2006.01) |
| ***C21D 9/00*** | (2006.01) |
| ***C22C 38/18*** | (2006.01) |
| ***C21D 6/00*** | (2006.01) |
| ***C21D 1/30*** | (2006.01) |
| ***C22C 38/02*** | (2006.01) |
| ***C22C 38/04*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/38*** | (2006.01) |
| ***C22C 38/50*** | (2006.01) |
| ***C22C 38/52*** | (2006.01) |
| ***C22C 38/00*** | (2006.01) |
| ***C22C 38/08*** | (2006.01) |
| ***C22C 38/14*** | (2006.01) |

(52) U.S. Cl.

CPC ..... *C22C 38/002* (2013.01); *C22C 38/005* (2013.01); *C22C 38/02* (2013.01); *C22C 38/04* (2013.01); *C22C 38/08* (2013.01); *C22C 38/12* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/44* (2013.01); *C22C 38/50* (2013.01); *C22C 38/52* (2013.01); *C21D 2211/001* (2013.01); *C21D 2211/002* (2013.01); *C21D 2211/003* (2013.01); *C21D 2211/008* (2013.01)

(56) References Cited

U.S. PATENT DOCUMENTS

| | | | | |
|---|---|---|---|---|
| 5,454,883 | A | 10/1995 | Yoshie et al. | |
| 2003/0099566 | A1* | 5/2003 | Lakeland | C22C 38/002 420/61 |

FOREIGN PATENT DOCUMENTS

| | | | | | |
|---|---|---|---|---|---|
| JP | 60110844 | A | * | 6/1985 | C22C 37/06 |
| JP | 01-104749 | | | 4/1989 | |
| JP | H11-222649 | A | | 8/1999 | |
| JP | 2001-131634 | | | 5/2001 | |
| JP | 2001-200341 | | | 7/2001 | |

OTHER PUBLICATIONS

Machine-English translation of JP2002-012952, Shimizu Keisuke et al., Jan. 15, 2002.*

Machine-English translation of JP360110844A, Yuji Okada et al., Jun. 17, 1985.*

English-hand translation of Japanese patent 58-123860, Kazuo Ito et al., Jul. 23, 1983.*

Machine-English translation of Japanese patent 57-023048, Kazuo Ito et al., Jul. 14, 1980.*

Jerzy Pacyna, "Effect of retained austenite on the fracture toughness of tempered tool Steel", Archives of Science and Engineering, Jun. 2008.*

International Search Report and accompanying Written Opinion, dated Sep. 3, 2013, with respect to International Application No. PCT/EP2013/059471.

Information from website of Daido Steel Co., Ltd. concerning "NAK 55 NAK80 40 HRC Pre-hardened Type High Performance, high Precision Plastic Mold Steel" www.daido.co.jp, Sep. 3, 2012.

Office Action issued Oct. 10, 2017 with respect to European Patent Application No. 13 730 125.5, International Application No. PCT/EP2013/059471.

* cited by examiner

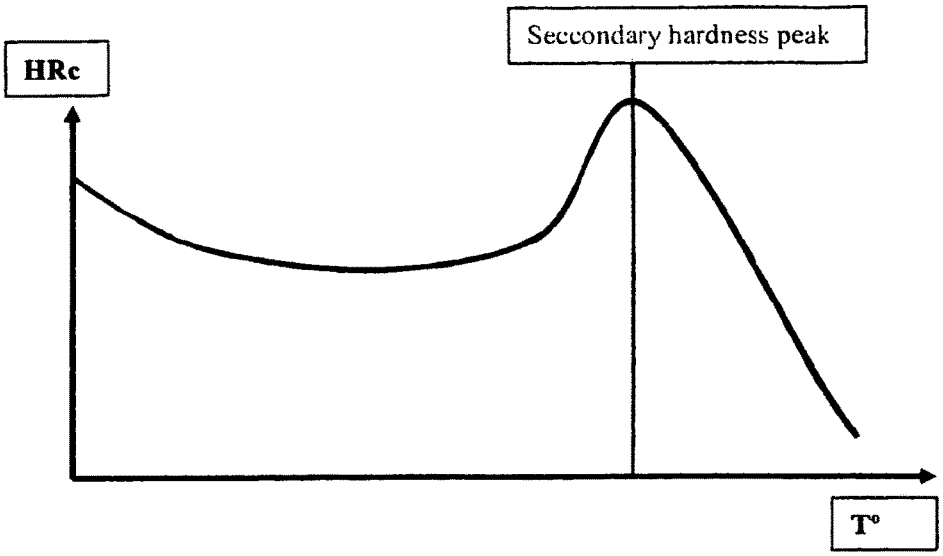
Seccondary hardness peak
HRc
T°

LOW TEMPERATURE HARDENABLE STEELS WITH EXCELLENT MACHINABILITY

FIELD OF THE INVENTION

The present invention relates to the application of fully and/or partially bainitic or interstitial martensitic heat treatments on certain steels, often tool steels or steels that can be used for tools. The first tranche of the heat treatment implying austenitization is applied so that the steel presents a low enough hardness to allow for advantageous shape modification, often trough machining. But the hardness can then also be raised to the working hardness with a simple beat treatment at low temperature (below austenitization temperature).

SUMMARY

Tool steels often require a combination of different properties which are considered opposed. A typical example can be the yield strength and toughness. For most tool steels the best compromise of such properties is believed to be obtainable when performing a purely martensitic heat treatment followed by the adequate tempering, to attain the desired hardness.

For heavy sections it is often impossible to attain pure martensitic microstructure through the whole cross-section, and very often it is not even possible to attain such a microstructure at the surface. Mixed microstructures with bainite and martensite have a particularly low fracture toughness which is very detrimental for several applications, like for example those where thermal fatigue is a dominant failure mechanism.

For most tool steels to attain a martensitic microstructure trough a heavy section implies the employment of very severe cooling that can easily lead to cracking.

The conventional way to manufacture a die comprises the following steps:

Tool steel rough machining.
Stress relieving.
Finalization of the rough machining.
Heat treatment
Final machining
Surface treatment (Nitriding, carburizing . . . ) and/or coating.

Dies not requiring very high wear resistance can skip the last step. When the geometry of the die is simple, often the stress-relieving step is skipped. For some not so demanding applications, it is customary and economically advantageous to use pre-hardened tool steels, thus avoiding heat treatment and proceeding to final machining right away. This is especially interesting for big dies since the cost of the heat treatment is proportional to the weight and the distortion associated to the heat treatment and thus mandatory final machining in hard condition is proportional to the size of the die. Also often this route is chosen due to the time saving in the execution of the project; at least one and a half weeks can be saved when proceeding in this way. The biggest handicap is that the pre-hardening hardness cannot be all too high since then the machining would be very costly, usually hardness below 45 HRc are chosen. It is interesting to notice that the final machining takes place at the final hardness level, where machining is usually considerably more resource consuming. Also for many applications, though it would be nice to benefit from the shortened implementation time and avoid costs associated to heat treatment, it is not possible to use pre-hardened tool steels because the application demands considerably higher bulk hardness.

With the improvement of machining capabilities in the last years, the machining of tool steels up to 40 HRc and even 45 HRc if they have some machinability enhancement additives or a fine, but not extremely tough, microstructure is present. In fact most pre-heat treated tool steels lie in the 30-40 HRc range with some special applications tool steels in the 40-45 HRc range. Indeed annealed tool steels are normally quite softer often below 250 HB, but the difference in the machinability is not so big. As mentioned many applications require though bulk hardness above 48 HRc. In cases where a bulk hardness below 45HRc is sufficient, but a higher surface hardness is desirable, which happens quite often, Pre-hardened tool steels are often nitrided. For many years it has been realized, and is one of the big advantages of tool steels, that it is desirable to have the tool steel soft when it is machined, and hard when it has to work. It should be as soft as possible when machining, but up to 40 HRc or even 45 HRc is acceptable, and sufficiently hard when working (the optimal hardness level is application dependent). For many applications the optimal working hardness falls in the 48-58 HRc range. Therefore often an increase of 10-20 HRc in the "hardening" process is sufficient for many applications.

In most applications, hardness is not the only relevant material property for the tool steel, but some other properties are as relevant or at least relevant enough to be taken into account when designing the tooling solution. Such properties can be: toughness (resilience or fracture toughness), resistance to working conditions (corrosion resistance, wear resistance, oxidation resistance at high temperatures, . . . ), thermal properties (thermal diffusivity, thermal conductivity, specific heat, heat expansion coefficient, . . . ), magnetic and/or electric properties, temperature resistance and many others. Often these properties are microstructure dependent and thus will be modified during heat treatment. So heat treatment is optimized to render the best property compromise for a given application.

There are some tool steels, or better-named special alloys, which use precipitation hardening as one of the main hardening mechanisms together with solid solution and sometimes ni-martensite. On some of those tool steels the softest possible state is the solubilized or solution annealed state which often lies around 30-40 HRc, and the heat treatment applied is a low temperature precipitation often rendering a 8-20 HRc hardness increase which is sufficient for many applications as explained. This low temperature precipitation has the advantage of often having a small and controllable distortion associated. The problem of those special alloys that can be substitutes for tool steels, are mainly the low wear resistance and the very high alloy manufacturing cost. Also their machinability is worse than that of a tool steel at the same hardness level mainly due to the extended usage of solid solution as a hardening mechanism.

Wear in material shaping processes is, primarily, abrasive and adhesive, although sometimes other wear mechanisms, like erosive and cavitative, are also present. To counteract abrasive wear hard particles are generally required in tool steels, these are normally ceramic particles like carbides, nitrides, borides or some combination of them. In this way, the volumetric fraction, hardness and morphology of the named hard particles will determine the material wear resistance for a given application. Also, the use hardness of the tool material is of great importance to determine the material durability under abrasive wear conditions. The hard particles morphology determines their adherence to the matrix and the size of the abrasive exogenous particle that can be counteracted without detaching itself from the tool material matrix. The best way to counteract the adhesive wear is to use FGM materials (functionally graded materials), normally in the form of ceramic coating on the tool material. In this case, it is very important to provide a good support for the coating which usually is quite brittle. To provide the coating with a good support, the tool material must be hard and have hard particles. In this way, for some industrial applications, it is desirable to have a tool material with high thermal diffusivity at a relatively high level of hardness and with hard particles in the form of secondary carbides, nitrides and/or borides and often also primary hard particles (in the case to have to counteract big abrasive particles).

In some applications the resistance to the working environment is more focused on corrosion or oxidation resistance than wear although both often co-exist. In such cases oxidation resistance at the working temperature or corrosion resistance against the aggressive agent are desirable. For such applications corrosion resistance tool steels are often employed, at different hardness levels and with different wear resistances depending on the application.

Thermal gradients are the cause of thermal shock and thermal fatigue. In many applications steady transmission states are not achieved due to low exposure times or limited amounts of energy from the source that causes a temperature gradient. The magnitude of thermal gradient for tool materials is also a function of their thermal conductivity (inverse proportionality applies to all cases with a sufficiently small Biot number).

Hence, in a specific application with a specific thermal flux density function, a material with a superior thermal conductivity is subject to a lower surface loading, since the resultant thermal gradient is lower. The same applies when the thermal expansion coefficient is lower and the Young's modulus is lower.

Traditionally, in many applications where thermal fatigue is the main failure mechanism, as in many casting or light alloy extrusions cases, it is desirable to maximize conductivity and toughness (usually fracture toughness and CVN).

Most forging applications use hardness in the 48-54 HRc range, plastic injection molding is preferably executed with tools having a hardness around 50-54 HRc, die casting of zink alloys is often performed with tools presenting a hardness in the 47-52 HRc range, hot stamping of coated sheet is mostly performed with tools presenting a hardness of 48-54 HRc and for uncoated sheets 54-58 HRc. For sheet drawing and cutting applications the most widely used hardness lies in the 56-66 HRc range. For some fine cutting applications even higher hardness are used in the 64-69 HRc.

STATE OF THE ART

Interrupted bainitic heat treatments have been used in JP1104749 (A) for a family of tool steels where special care has been taken to try to avoid the coarse precipitation of cementite, and its associated brittleness, trough the addition of Al. In the present invention the hardening and tempering does also imply some geometric transformation, normally trough machining, in between the complete process but toughness is either managed at lower levels for some applications or the strategy of having a higher degree of replacement of cementite trough other carbides is pursued. On top in the present invention solutions with considerably higher corrosion resistance, thermal conductivity, wear resistance, economic advantage and/or toughness are achieved.

The effect of having a lower hardness for machining and a higher one for working and being able to go from the lower hardness to the higher hardness with a low temperature (below austenitization) heat treatment is often used in the so called precipitation hardening steels. Those steels are characterized by having an austenitic, even ferritic, substitutional martensite or even low carbon interstitial martensitic microstructure where the precipitates nucleate and grow to the desired size during the heat treatment to provide the increase in hardness and mechanical strength. Many such steels exist, as an example could be mentioned the maraging steels, precipitation hardening tool steels like in U.S. Pat. No. 2,715,576, JP1104749 or the well-known Daido Steel Limited NAK55 and NAK80. The differences of such steels from the steels of the present invention is the whole conception, microstructures used, which in this case reflect mostly even in the compositional ranges employed and temperatures employed for the heat treatments.

SUMMARY OF THE INVENTION

The authors have discovered that the problem of having a low enough hardness during the machining and then having the desired combination of relevant properties for the given application comprising a higher hardness, without having to austenitize the tool steel at high temperatures, can be solved with a steel and a method for manufacturing steel. Inventive uses and preferred embodiments follow from the other claims.

By applying a bainitic or partially bainitic heat treatment to a tool steel presenting a large enough secondary hardness peak, and supplying for machining the tool steel after quenching or with one or more tempering cycles at temperatures below the temperature where the maximum hardness peak occurs, rendering a low enough hardness for the machining can be generated. And after the machining, or part of it, applying at least one stress relieving, nitriding or tempering at a temperature below austenitizing temperature, delivers the desired hardness.

Alternatively a martensitic heat treatment can be performed. This is advantageous if the hardness gradient between the lowest point before the secondary hardness peak and the maximum secondary hardness is big.

One additional advantage of bainitic heat treatments is that they can be attained with a less abrupt quenching rate. Also for some tool steels they can deliver a similar microstructure trough a thicker section. For some tool steels with a retarded bainitic transformation it is possible to attain a perfectly homogeneous bainitic microstructure trough an extremely heavy section.

Bainite can be very fine and deliver high hardness and toughness if the transformation occurs at low enough temperatures. Many applications require high toughness, whether resilience or fracture toughness. In plastic injection applications often thin walls (in terms of resistant cross-section) are subjected to high pressures. When those walls are tall a big moment is generated on the base that often has a small radius, and thus high levels of fracture toughness are required. In hot working applications, the steels are often subjected to severe thermal cycling, leading to cracks on corners or heat checking on the surface. To avoid the fast propagation of such cracks it is also important for those steels to have as high as possible fracture toughness at the working temperature. Many efforts have been placed to attain purely martensitic structures in such applications, either through proper alloying to delay bainitic transformation kinetics, or through the development of methods to increase the cooling rate but avoiding cracking. The authors have observed that what is quite detrimental for toughness, and especially fracture toughness is the mixture of martensite and bainite, even for small quantities of the latter. But if bainite is the only phase present, or at least the dominant phase, and especially if the bainite is a fine lower bainite then very high values of toughness can be attained, also fracture toughness at high temperatures. The authors have also observed that even for higher and coarser bainite, when the alloying level is high enough and the proper tempering strategy is followed, then most of the coarse cementite can be replaced by finer carbides and good toughness values achieved especially at higher temperatures. As mentioned, martensitic heat treatments are often difficult to attain for heavy sections, or they might involve alloying which is detrimental for other properties.

The inventors have realized that a very convenient way to have a material that can be easily shaped and yet presents a high working hardness without the unforeseable deformations associated to quenching consists on the manufacture of a steel, often a tool steel or a steel that can be used to build tools, delivered in a condition such that after the delivery the bulk hardness can be raised through a heat treatment comprising temperatures below austenitization and not requiring any particularly fast cooling. The delivery condition will comprise an interstitial martensitic and/or partially bainitic or any of the above but partially tempered microstructure.

BRIEF DESCRIPTION OF DRAWING

FIG. 1 shows a tempering graph where hardness evolution of the steel against temperature is shown.

DETAILED DESCRIPTION OF THE INVENTION

It is possible within the present invention to obtain tool steels or any steel that has to undergo a machining process prior to its application in a condition where it is easy to machine and then be able to transform it to a microstructure of higher performance by applying a heat treatment that involves only temperatures below austenitization temperature and no requirements for a fast cooling rate, providing then a controllable, and small distortion.

Tools are often machined from pre-heated tool steels, especially big tools where the production cost of the tool plays a big role. Since in many cases large amounts of machining are involved it is important for the pre-hardened tool steels to have good machinability. For this purpose, these steels have often elements added to enhance machinability like S, Ca, Bi and even Pb. Moreover they present often an homogeneous microstructure in the sense of size and distribution of carbides. Most importantly the hardness levels to which they are pre-hardened are those where machining can be carried out at fast stock removing speeds. Although machining techniques do not cease to improve, and thus the hardness level for which fast stock removal is still possible continues to increase, a good general hardness level would be <40 HRc for very fast machinability and rarely levels of 45 HRc are exceeded. Probably 48 HRc would the maximum reasonable limit. For many applications though, 40 HRc (respectively 45 HRc or even 48 HRc) are not sufficient and pre-hardened steels are associated to not excessively high productivities for many applications. For applications requiring higher mechanical properties, a different route is normally employed, which normally implies higher costs for the manufacturing of the die, that are afterwards recovered through the higher performance (often in terms of durability) of the die. This route implies a rough machining in annealed state, where the material is soft, heat treatment and final machining (mandatory to compensate the distortions occurred during heat treatment). The final machining occurs with the material already hard and thus is comparatively more difficult and costly.

Some pre-hardened tool steels are chosen to have a high enough tempering temperature at which the hardness is fixed so that afterwards superficial treatments or even coatings can be applied at lower temperatures (to avoid distortion and loss of hardness), in such a way increasing the tribological performance of the die. The tool steel according to the present invention benefits from the advantages of both manufacturing routes. The tool steel is provided as a pre-hardened tool steel in terms of hardness for fast stock removal during machining and then the material is brought to a state of superior hardness but without the uncontrolled distortion of a quenching process. What is required to attain the hardness increase is a temper-like heat treatment. Since normally not hardness alone will be a relevant property different heat treatment combinations will be desirable for every tool steel where the present invention is applicable (heat treatment combination refers to the lower hardness treatment performed before delivery, and the under austenitization temperature treatment or treatments performed afterwards). For some of these combinations the deformation associated to the last part of the treatment is either small or with a high enough reproducibility to not necessarily require any dimensional correcting machining at a high hardness level. In such cases the treatment bringing the steel to the high performance level, or part of it might be made as a consequence of another necessary process like a nitriding, coating, stress relieving . . . . It is also possible especially for pieces with heavy machining to make coincide the treatment with a stress relieving while leaving some extra stock for machining in a higher hardness condition (to correct possible unpredictable deformations due to the fiber cutting during the machining.

Advantageously, the tool steel or steel usable for tooling, or steel in general, have a secondary hardness maximum in the tempering curve with a significantly lower hardness at a given lower tempering temperature point. For the steels of the present invention, this maximum hardness gradient between the maximum secondary hardness peak in the tempering curve and the point of minimum hardness at lower tempering temperature than the tempering temperature leading to the secondary hardness peak, should be usually at least 4 HRc, often more than 7 HRc, preferably more than 8 HRc, even more preferably at least 10 HRc. For applications where the end hardness is quite high, it is desirable, and can also be attained within the present invention when following the indicated steps, to have a hardness gradient, as above described, of at least 15 HRc and preferably more than 18 HRc or even more than 20 HRc.

The present invention is especially interesting for a broad range of applications when the hardness can be raised with a low temperature (below austenitization) heat treatment, acting as tempering. For most applications a hardness above 48 HRc is desirable. For applications requiring high mechanical resistance normally 50HRc or even 52HRc should be attainable, for applications with high superficial pressures (like for example when wrinkling occurs in cold or hot drawing applications) 54HRc or even 56 HRc should be attainable. And for cutting and drawing applications often more than 60 HRc, and even more than 62 HRc are desirable. Applications with high wear might require even higher hardness above 64 HRc and even above 67 HRc. These hardness levels can be attained within the present invention, when following the indicated steps.

The present invention is based on a combination of alloying and properly chosen microstructures. Very significant are also the heat treatments and how those heat treatments are applied. For many applications of the present invention, the preferred microstructure is predominantly bainitic, at least 50% vol %, preferably 65% vol %, more preferably 76% vol % and even more preferably more than 92% vol %, since is normally the type of microstructure easier to attain in heavy sections and also because is the microstructure normally presenting the highest secondary hardness difference upon proper tempering.

For some applications, especially those requiring heavy sections with materials presenting limited hardenability in the bainitic regime, High Temperature bainite will be preferred since it is the first bainite to form when cooling the steel after austenitization. In this document High Temperature bainite refers to any microstructure formed at temperatures above the temperature corresponding to the bainite nose in the TTT diagram but below the temperature where the ferritic/perlitic transformation ends, but it excludes lower bainite as referred in the literature, which can occasionally form in small amounts also in isothermal treatments at temperatures above the one of the bainitic nose. For the applications requiring high easy hardenability, the high temperature bainite should be the majoritary type of bainite and thus from all bainite is preferred at least 50% vol %, preferably 65% vol %, more preferably 75% vol % and even more preferably more than 85% vol % to be High Temperature Bainite. As it is well known in metallurgical terms, bainite is one of the decomposition products when austenite is not cooled under thermodinamical equilibrium. It consists of a fine non-lamellar structure of cementite and dislocation-rich ferrite plates as it is a non-difusion process. The high concentration of dislocations in the ferrite present in the bainite makes this ferrite harder than it would normally be. Often high temperature bainite will be predominantly Upper Bainite, which refers to the coarser bainite microstructure formed at the higher temperatures range within the bainite region, to be seen in the TTT temperature-time-transformation diagram, which in turn, depends on the steel composition. The inventors have found that a way to increase the toughness of the High Temperature Bainite, including the Upper Bainite is to reduce the grain size, and thus for the present invention when Tough Upper Bainite is required, grain sizes of ASTM 8 or more, preferably 10 or more and more preferably 13 or more are advantageous. The inventors have also seen that surprisingly high values of toughness can be attained with High Temperature Bainite when using microstructures where cementite has been supressed, strongly reduced and/or its morphology altered to finer lamella or even more so when the cementite is globulized. For bainites including retained austenite, the same applies for the morphology of the retained austenite phase. This is what is referred as Tough High Temperature Bainite in this application: small grain size high temperature bainite and/or low cementite bainite and/or fine lamella or globular morphology high temperature bainite. For some applications it is clearly preferred to have most of the high temperature bainite being tough high temperature bainite at a volume fraction of more than a 60%, preferably more than 78%, and even more preferably more than 88% in volume percent. The inventors have found that specially for low % Si alloys (lower than 1%, especially lower than 0.6% and even more specially lower than 0.18%), high contents of globular bainite provide very high resilience which is of high interest for several applications. In this case it is desirable to have 34% of all bainite or more to be of globular morphology, preferably 55% or more, more preferably 72% or more and more preferably 88% or more. In some instances it is even possible to have all bainite having a globular morphology. When combined with small grain size as described above for the High Temperature Bainite in general, even unexpected high values of fracture toughness can be attained. For some applications having some ferrite and or perlite is not too detrimental, so for most applications no ferrite/perlite will be desirable or at the most a 2% or eventually a 5%. The applications more tolerant to ferrite/perlite can allow up to a 10% or even a 18%. In a bainitic microstructure generally the presence of martensite leads to a decrease in fracture toughness, for applications where fracture toughness is not so important there are no restrictions on the fraction of bainite and martensite, but the applications where fracture toughness matters on predominantly bainitic microstructures will prefer the absence of martensite or at most its presence up to a 2% or possibly up to 4%. For some compositions 8% or even 17% of martensite might be tolerable and yet maintaining a high fracture toughness level.

If high fracture toughness at lower temperatures is desirable, in heavy cross sections, there are two possible strategies to be followed for the steels of the present invention within the predominantly bainitic heat treatments. Either alloy the steel to assure the martensitic transformation temperature is low enough (normally lower than 400° C., preferably lower than 340° C., more preferably lower than 290° C. and even lower than 240° C. For extremely fine bainite, but often associated with very slow transformation kinetics, the transformation temperature should be below 220° C., preferably below 180° C. and even below 140° C., and all transformation kinetics to stable and not so desirable structures (ferrite/perlite, upper bainite) should be slow enough (at least 600 seconds for 10% ferrite/perlite transformation, preferably more than 1200 seconds for 10% ferrite/perlite transformation, more preferably more than 2200 seconds for 10% ferrite/perlite transformation and even more preferably more than 7000 seconds for 10% ferrite/perlite transformation. Also more than 400 seconds for 20% transformation into bainite, preferably more than 800 seconds for 20% bainite, more preferably more than 2100 seconds for 20% bainite and most preferably even more than 6200 seconds for 20% bainite).

Alternatively the alloying content regarding elements with higher propensity than Fe to alloy with % C, % N and % B has to be chosen to be high enough. Elements having an affinity for carbon higher than iron are Hf, Ti, Zr, Nb, V, W, Cr, Mo as most important ones and will be referred in this document as strong carbide formers (special attention has to be applied since this definition does not coincide with the most common one in the literature where often Cr, W and even Mo and V are often not referred as strong carbide formers). Elements with higher carbon affinity than Fe will form their respective carbides or a combination of them before the iron carbide can form, from now on referred to as alloyed carbides. Depending on the carbide itself, properties can vary. Special cases are later on and depending on the particular properties sought, properly described. In this sense, most significant are the presence of % Moeq, % V, % Nb, % Zr, % Ta, % Hf, to a lesser extent % Cr and all other carbide formers. Often more than 4% in weight in the sum of elements with higher affinity for carbon than iron will be present, preferably more than 6.2%, more preferably more than 7.2% and even more than 8.4%. Given the high secondary hardness peak provided by % Moeq, often more than 4.2%, preferably more than 5.2% and even more than 6.2% will be present for a preferred embodiment of the invention. In the same way % V can be employed and often more than 0.2% is used, preferably more than 0.6%, more preferably more than 2.4% and most preferably even more than 8.4%. Finally if primary carbides are not detrimental for the application and cost allows, very strong carbide formers (% Zr+% Ta+% Nb+% Hf) will be used in an amount exceeding 0.1%, preferably 0.3% and most preferably even 0.6%. It is convenient that at least 30% vol % of the carbides, preferably 35% vol %, more preferably 40% vol % and even more preferably more than 45% vol % of carbides have at least 50% at %, preferably 55% at %, more preferably 60% at % and even more preferably more than 75% at % iron of all metallic constituents of the carbides. This allows for the desired hardness increase after the application of the low temperature (below AC1) heat treatment process, usually carried out at the end user's side.

Additionally any thermo-mechanical treatment leading to a refining of the final grain size is advantageous, especially for predominantly bainitic heat treatments because then the effect is not only the improvement of toughness but also in the increase of hardenability. The same applies for treatments avoiding carbide precipitation on grain boundaries. Such a treatment can be, for example, a first step at high temperatures above 1.020° C. to coarsen the austenite grain size (since it is a diffusion process the higher the temperature is, the lower is the time required, strain can also be introduced trough mechanical deformation but recrystallization avoided at this point). Then the steel is cooled fast enough to avoid transformation into stable microstructures (ferrite/perlite, and also bainite as much as possible) and also to minimize carbide precipitation. Finally the steel is stress released at a temperature close to Ac1. This will promote the nucleation of very fine grains in the final heat treatment, especially if it is predominantly bainitic. Predominantly martensitic structures can also be desirable in the present invention if the secondary hardness peak is high enough to enable for a low hardness machining and afterwards significant rising of the hardness upon tempering. Predominantly "martensitic structures" refers to a microstructure consisting of at least 50% vol % interstitial martensite, preferably 65% vol % interstitial martensite, more preferably 78% vol % interstitial martensite and even more preferably more than 88% vol % interstitial martensite. Retained austenite can also lead to a desirable hardness increase upon decomposition during a tempering process. This transformation is not the most desirable but it can be used in the present invention for some applications where the rather uncontrolled volume change associated is not too critical. If little retained austenite is present then the effect of its decomposition is small and thus has to be necessarily supplemented by the precipitation or separation of alloyed carbides. Alloyed carbides are those with a high amount of metallic elements which are stronger carbide builders than iron (more than 42% at %, preferably more than 62% at % and even more preferably more than 82% at % of the total amount of metallic constituents of the carbide), in the sense already described. Thus when retained austenite is present in an amount of less than 2.9%, particularly less than 2.5% and even more so less than 1.8% in vol %, then carbide formers stronger than iron have to be present in solid solution or any other state that allows the formation of their carbides or mixed carbides the so called in this application and often in literature alloy carbides, without the need of re-dissolution at temperatures above Ad. It is desirable in this case to have a 2.2% or more, more preferably a 3% or more and more preferably a 3.8% or more in weight percent of these strong carbide formers.

If retained austenite is present in very large amounts like more than 52%, particularly more than 60% and even more so when it is more than 72%, then the presence of elements capable of forming alloyed carbides can be omitted. For the in-between cases, it can be sufficient with 1.2%, preferably more than 1.8% or even also more than 2.1% in weight percent of the strong carbide formers.

Fully martensitic structures are desirable but difficult to attain for heavy sections, so normally up to a 8% or even 24% bainite can be tolerated. The amounts of ferrite/perlite admissible coincide with those of the bainitic treatment, although the compositions will generally vary.

There are numerous reports in the literature about the existence of very tough lower bainite under some quite restrictive conditions that lead to poor tribological performance for some applications. The inventors have seen that this can be solved with the usage of alloyed carbides, when % C is well equilibrated as explained in more detail later. In general for those applications it is desirable to have a 2% or more carbide formers stronger than iron, preferably a 3.2% or more, more preferably a 4.6 or more or even a 7.6 or more. There are even fewer reports in the literature of the existence of tough bainite structures in the high temperature bainite regime, like for example globular or globalized bainite, and it is always associated to low % C contents, normally in the range of % C<0.2 in weight percent. While this structure is very desirable for many applications in the present invention, most of those applications require mechanical and tribological properties which are with extreme difficulty attained with such low % C contents. The inventors have seen that surprisingly in the current invention such structures can be attained for considerably higher % C contents. It is a peculiarity of the present invention to have simultaneously tough high temperature bainite and more than 0.21% weight % C, preferably more than 0.26%, more preferably more than 0.31%, even more preferably more than 0.34%, and most preferably even more than 0.38%. The way this is achieved is by having some of the nominal % C—the theoretical total % C of the steel—not participating in the austenite to bainite transformation. One effective way to do so is to have some of the % C bound to carbides right before the transformation starts and during the transformation. This can be accomplished by not dissolving all carbides during the austenization, or by performing a controlled cooling so that carbide precipitation takes place before the bainitic transformation. This strategy can also be employed when lower % C martensite is desirable. In this sense, it is advantageous for some applications of the present invention to have 5% or more of the nominal weight % C in the form of carbides formed before the bainitic and/or martensitic transformation, preferably 8% or more, more preferably 12% or more and even 23% or more. Given that carbon formation is not the only way to inhabilitate it during the martensitic and/or bainitic transformation, it is more clear to account for the nominal % C that participates and thus gets incorporated to the martensitic and/or bainitic transformation. This is a microstructural reference, since a detailed analysis of the microstructure provides the % C of all phases other than the martensite and/or bainite, which can be subtracted from the nominal % C and finally seen what percentage it represents. So for some applications it is desired that the martensite and/or bainite account for less than 88% of the nominal C % of the steel, preferably less than 80%, more preferably less than 72% and even more preferably less than 66% of the nominal C % of the steel. For some other applications it is desired that the martensite and/or bainite account for less than 88% of the nominal C % of the steel, preferably less than 80%, more preferably less than 72% and even more preferably less than 66% of the nominal C % of the untempered steel. In metallurgical terms, composition of steels is normally given in terms of Ceq, which is defined as carbon upon the structure considering not only carbon itself, or nominal carbon, but also all elements which have a similar effect on the cubic structures of the steel, normally being B, N.

Both preferred microstructures are known as metastable microstructures of non-equilibrium phases which form by means of non-diffusion processes which occur when cooling from the austenite phase faster than the equilibrium rate. Carbon placed in interstitial places from the face-centered cubic structure of austenite has not enough time to go out from the structure because of the fast cooling and most of it remains in the structure inducing shear stresses which finally lead to the bainite or martensite structure, depending on cooling rate and steel composition. Those structures are often rather brittle right after quenching and one way to recover some ductility and/or toughness is by tempering them. In this application references are made to tempered martensite (mostly interstitial) and tempered bainite, with this terminology in this text referring to a martensite and/or bainite that has undergone any type of heating after forming (during the quenching process). This heating leads at first to a relaxation of the structure, followed by a migration of the carbon atoms (often the resulting microstructures are given particular names in the literature: Troostite, Sorbite . . . ), transformation of the retained austenite if present, precipitation of alloyed carbides and/or morphology change and redisolution of any type of carbides (cementite and alloyed carbides included) amongst others. Which mechanisms actually take place and to what extent depends on the steel composition, original microstructure and the temperature and time of the tempering cycles applied. So any heating after quenching (formation of the martensite and/or bainite) leads to the tempered martensite and/or tempered Bainite as referred to in this application. Often during the implementation of the present invention a tempering (which might be a multiple one) takes place during the manufacturing of the steel, and another tempering (which again might be a multiple one) takes place during the usage of the steel to manufacture a component or tool. Depending on the tempering temperature used and time, as mentioned at the beginning of this paragraph, different amounts of carbon will be expelled and different mechanisms will be involved giving rise to different microstructures and often having an effect on the hardness of the steel. For this purpose, steels are also often referred to their tempering graph, where hardness evolution against temperature is plotted (see FIG. 1). Normal behavior consists of a drop of hardness on the first stages of tempering followed by a hardness increase if, amongst others, retained austenite and/or formation of alloyed carbides takes place. For the present invention, interest will be placed on the so-called maximum secondary hardness peak, which is the point in the tempering graph where this hardness increase reaches its maximum before hardness starts falling again due to coarsening and/or redisolution of carbides and other precipitates.

The inventive method for manufacturing the steel product comprises the following steps (a) providing a steel composition having at least one of the following components, all percentages being in weight percent:
% Ni<1% or
% Cr>4% or
% C>=0.33% or
% Mo>2.5% or
% Al<0.6% or
at least one of W, Zr, Ta, Hf, Nb is >=0.01% or
at least one of S, P, Bi, Se, Te is >=0.01%, (b) Determining the critical temperature for the initiation of the formation of austenite upon heating (Ac1) for the selected composition.

(c) Providing a heat treatment to the steel comprising heating up above Ac1 and cooling Preferably the method is further characterized by a microstructure consisting of at least 50% vol. % bainite. Other embodiments further comprise a microstructure consisting of at least a 50 vol. % interstitial martensite and retained austenite present in a 2.5-60% vol., and carbide formers stronger than iron present in a 2% weight or more in solid solution. Further embodiments comprise a microstructure consisting of at least a 50 vol. % interstitial martensite and retained austenite is present in less than a 2.5% vol., and carbide formers stronger than iron are present in a 3% weight or more in solid solution.

Other embodiments of the method of the present invention further comprise: determining the tempering graph for the steel with the applied heat treatment, stress relieving or tempering the steel to a temperature below the temperature of the maximum secondary hardness peak, machining the steel, applying a heat treatment consisting on heating to a temperature according to the tempering graph corresponding to a hardness increase of 4 HRc or more.

The present invention is especially well suited to obtain steels for the hot stamping tooling applications. The steels of the present invention perform especially well when used for plastic injection tooling. They are also well fitted as tooling for die casting applications. Another field of interest for the steels of the present document is the drawing and cutting of sheets or other abrasive components. Also forging applications are very interesting for the steels of the present invention, especially for closed die forging. Also for medical, alimentary and pharmaceutical tooling applications the steels of the present invention are of especial interest.

The present invention suits especially well when using steels presenting high thermal conductivity (thermal conductivity above 35 W/mK, preferably 38/mK, more preferably 42 W/mK, more preferably 48 W/mK and even 52 W/mK), since their heat treatment is often complicated especially for dies with a large or complex geometry. In such cases the usage of the present invention can lead to very significant cost savings. According to a preferred embodiment of the invention, the steel, especially the high thermal conductivity steel, can have the following composition, all percentages being indicated in weight percent:

| | | | |
|---|---|---|---|
| % $C_{eq}$ = 0.16 – 1.9 | % C = 0.16 – 1.9 | % N = 0 – 1.0 | % B = 0 – 0.6 |
| % Cr < 3.0 | % Ni = 0 – 6 | % Si = 0 – 1.4 | % Mn = 0 – 3 |
| % Al = 0 – 2.5 | % Mo = 0 – 10 | % W = 0 – 10 | % Ti = 0 – 2 |
| % Ta = 0 – 3 | % Zr = 0 – 3 | % Hf = 0 – 3 | % V = 0 – 4 |
| % Nb = 0 – 1.5 | % Cu = 0 – 2 | % Co = 0 – 6, | |

the rest consisting of iron and trace elements wherein, $$\% C_{eq} = \% C + 0.86 * \% N + 1.2 * \% B,$$

characterized in that $$\% Mo + \tfrac{1}{2} \cdot \% W > 2.0.$$

This composition as such forms an invention without the restrictions of claims 1 and 3.

In the meaning of this patent, trace elements refer to any element, otherwise indicated, in a quantity less than 2%. For some applications, trace elements are preferable to be less than 1.4%, more preferable less than 0.9% and sometimes even more preferable to be less than 0.78%. Possible elements considered to be trace elements are H, He, Xe, Be, O, F, Ne, Na, Mg, P, S, Cl, Ar, K, Ca, Sc, Fe, Zn, Ga, Ge, As, Se, Br, Kr, Rb, Sr, Y, Tc, Ru, Rh, Pd, Ag, Cd, In, Sn, Sb, Te, I, Xe, Cs, Ba, La, Ce, Pr, Nd, Pm, Sm, Eu, Gd, Tb, Dy, Ho, Er, Tm, Yb, Lu, Re, Os, Ir, Pt, Au, Hg, Tl, Pb, Bi, Po, At, Rn, Fr, Ra, Ac, Th, Pa, U, Np, Pu, Am, Cm, Bk, Cf, Es, Fm, Md, No, Lr, Rf, Db, Sg, Bh, Hs, Mt alone and/or in combination. For some applications, some trace elements or even trace elements in general can be quite detrimental for a particular relevant property (like it can be the case sometimes for thermal conductivity and toughness). For such applications it will be desirable to keep trace elements below a 0.4%, preferably below a 0.2%, more preferably below 0.14% or even below 0.06%.

It should be clear that from all the possible compositions within the range only those are of interest where the microstructure described in the present invention is attainable. Some smaller ranges within the above mentioned compositional range are of special significance for certain applications. For example when it comes to the % Ceq content it is preferably to have a minimum value of 0.22% or even 0.33%. On the other hand for very high conductivity applications it is better to keep % C below 1.5% and preferably below 0.9%. % Ceq has a strong effect in reducing the temperature at which martensitic transformation starts, thus higher values of % Ceq will be desirable for either high wear resistance applications or applications where a fine bainite is desirable. In such cases it is desirable to have a minimum of 0.4% of Ceq often more than 0.5% and even more than 0.8%. If some other elements that reduce the martensite transformation temperature are present (like for example % Ni) then the same effect can be obtained with lower % Ceq (same levels as described before). Also the % Moeq (% Mo+½·% W) levels should be higher for maximum thermal conductivity, normally above 3.0% often above 3.5%, preferably above 4% or even 4.5%. But high levels of % Moeq do tend to shorten the bainitic transformation time. Also if thermal conductivity needs to be maximized is better to do so within a compositional range with lower % Cr, normally less than 2.8% preferably less than 1.8% and even less than 0.3%. A special attention has to be placed in elements that increase hardenability by slowing the kinetics of the austenite decomposition into ferrite/perlite. Very effective in this sense is % Ni and somewhat less % Mn. Thus for heavy sections it is often desirable to have a minimum % Ni content normally 1%, preferably 1.5% and even 3%. If % Mn is chosen for this goal higher amounts are required to attain the same effect. About double as much quantity is required as is the case for % Ni. For applications where the steel is to attain temperatures in excess of 400° C. during service it might be very interesting to have % Co present which tends to increase tempering resistance amongst others and presents the odd effect of affecting the thermal diffusivity positively for high temperatures. Although for some compositions an amount of 0.8% might suffice, normally it is desirable to have a minimum of 1.0% preferably 1.5% and for some applications even 2.7%. Also for applications where wear resistance is important it is advantageous to use strong carbide formers, then % Zr+% Hf+% Nb+% Ta should be above 0.2%, preferably 0.8% and even 1.2%. Also % V is a good carbide former that tends to form quite fine colonies but has a higher incidence on thermal conductivity than some of the former, but in applications where thermal conductivity should be high but is not required to be extremely high and wear resistance and toughness are both important, it will generally be used with a content above 0.1%, preferably 0.3% and most preferably even more than 0.55%. For very high wear resistance applications it can be used with a content higher than 1.2% or even 2.2%. Other elements may be present, especially those with little effect on the objective of the present invention. In general it is expected to have less than 2% of other elements (elements not specifically cited), preferably 1%, more preferably 0.45% and even 0.2%.

So, for such kind of steels, unusually high final tempering-like temperatures (final tranche of the heat treatment to raise hardness) end up being used, often above 600° C., even when values for the hardness over 50 HRc are chosen. In steels of the present invention it is usual to achieve a hardness of 47 HRc, sometimes more than 52 HRc, and often more than 53 HRc and with the embodiments regarded as particularly advantageous due to their wear resistance, a hardness above 54HRc, and often above 56 HRc is possible with even one tempering cycle above 590° C., giving a low scattering structure characterized by a thermal diffusivity higher than 8 $mm^2/s$ and often more than 9 $mm^2/s$, or even more than 10 $mm^2/s$, when particularly well executed even greater than 11 $mm^2/s$, even greater than 12 $mm^2/s$ and occasionally above 12.5 $mm^2/s$. As well as achieving hardness greater than 46 HRc, even more than 50 HRc with the last tempering cycle above 600° C., often above 640° C., and sometimes even above 660° C., presenting a low scattering structure characterized by a thermal diffusivity higher than 10 $mm^2/s$, or even than 12 $mm^2/s$, when particularly well executed then greater than 14 $mm^2/s$, even greater than 15 $mm^2/s$ and occasionally above 16 $mm^2/s$. Those alloys can present even higher hardness with lowering tempering temperatures, but for most of the intended applications a high tempering resistance is very desirable. As can be seen in the examples with some very particular embodiments with high carbon and high alloying, leading to a high volume fraction of hard particles, a hardness above 60 HRc with low scattering structures characterized by thermal diffusivity above 8 $mm^2/s$ and generally more than 9 $mm^2/s$ are possible in the present invention.

According to a preferred embodiment of the present invention the steels can have the following composition, all percentages being indicated in weight percent:

| | | | |
|---|---|---|---|
| $\% C_{eq}$ = 0.15 – 3.0 | % C = 0.15 – 3.0 | % N = 0 – 1.6 | % B = 0 – 2.0 |
| % Cr > 4.0 | % Ni = 0 – 6.0 | % Si = 0 – 2.0 | % Mn = 0 – 3 |
| % Al = 0 – 2.5 | % Mo = 0 – 15 | % W = 0 – 15 | % Ti = 0 – 2 |
| % Ta = 0 – 3 | % Zr = 0 – 3 | % Hf = 0 – 3 | % V = 0 – 12 |
| % Nb = 0 – 3 | % Cu = 0 – 2 | % Co = 0 – 6, | |

the rest consisting of iron and trace elements wherein, $$\% C_{eq} = \% C + 0.86 * \% N + 1.2 * \% B,$$

This composition as such forms an invention without the restrictions of claims 1 and 3.

It should be clear that from all the possible compositions within the range only those are of interest where the microstructure described in the present invention is attainable. Some smaller ranges within the above mentioned compositional range are of special significance for certain applications. For example when it comes to the % Ceq content it is preferably to have a minimum value of 0.22%, preferably 0.28% more preferably 0.34% and when wear resistance is preferably 0.42% and even more preferably 0.56%. Very high levels of % Ceq are interesting due to the low temperature at which martensite transformation starts. Such applications favor % Ceq maximum levels of 1.2%, preferably 1.8% and even 2.8%. Applications where toughness is very important favor lower % Ceq contents, and thus maximum levels should remain under 0.9% preferably 0.7% and for very high toughness under 0.57%. Although a noticeable ambient resistance can be attained with 4% Cr, usually higher levels of % Cr are recommendable, normally more than 8% or even more than 10%. For some special attacks like those of chlorides it is highly recommendable to have % Mo present in the steel, normally more than 2% and even more than 3.4% offer a significant effect in this sense. Also for applications where wear resistance is important it is advantageous to use strong carbide formers, then O/Zr % Hf+% Nb+% Ta should be above 0.2%, preferably 0.8% and even 1.2%. Also % V is good carbide former that tends to form quite fine colonies but has a higher incidence on thermal conductivity than some of the former, but in applications where thermal conductivity should be high but is not required to be extremely high and wear resistance and toughness are both important, it will generally be used with a content above 0.1%, preferably 0.54% and even more than 1.15%. For very high wear resistance applications it can be used with content higher than 6.2% or even 8.2%. Other elements may be present, especially those with little effect on the objective of the present invention. In general it is expected to have less than 2% of other elements (elements not specifically cited), preferably 1%, more preferably 0.45% and even 0.2%.

The steels described above can be particularly interesting for applications requiring a steel with improved ambient resistance, especially when high levels of mechanical characteristics are desirable and the cost associated to heat treatment (both in terms of time and money) for its execution or associated distortions, are significant.

According to another preferred embodiment of the present invention the steels can have the following composition, all percentages being indicated in weight percent:

| | | | |
|---|---|---|---|
| % $C_{eq}$ = 0.15 – 2.0 | % C = 0.15 – 0.9 | % N = 0 – 0.6 | % B = 0 – 0.6 |
| % Cr > 11.0 | % Ni = 0 – 12 | % Si = 0 – 2.4 | % Mn = 0 – 3 |
| % Al = 0 – 2.5 | % Mo = 0 – 10 | % W = 0 – 10 | % Ti = 0 – 2 |
| % Ta = 0 – 3 | % Zr = 0 – 3 | % Hf = 0 – 3 | % V = 0 – 12 |
| % Nb = 0 – 3 | % Cu = 0 – 2 | % Co = 0 – 12, | |

the rest consisting of iron and trace elements wherein, $$\% C_{eq} = \% C + 0.86 * \% N + 1.2 * \% B,$$

This composition as such forms an invention without the restrictions of claims 1 and 3.

It should be clear that from all the possible compositions within the range only those are of interest where the microstructure described in the present invention is attainable. Some smaller ranges within the above mentioned compositional range are of special significance for certain applications. For example when it comes to the % Ceq content it is preferably to have a minimum value of 0.22%, preferably 0.38% more preferably 0.54% and when wear resistance is important preferably 0.82%, more preferably 1.06% and even more than 1.44%. Very high levels of % Ceq are interesting due to the low temperature at which martensite transformation starts, such applications favor % Ceq maximum levels of 0.8%, preferably 1.4% and even 1.8%. Applications where toughness is very important favor lower % Ceq contents, and thus maximum levels should remain under 0.9% preferably 0.7% and for very high toughness under 0.57%. Although corrosion resistance for martensitic microstructure can be attained with 11% Cr, usually higher levels of % Cr are recommendable, normally more than 12% or even more than 16%. For some special attacks like those of chlorides and to enhance hardness gradient at the secondary hardness peak it is highly recommendable to have % Moeq present in the steel, often more than 0.4%, preferably more than 1.2% and even more than 2.2% offer a significant effect in this sense. Also for applications where wear resistance or thermal conductivity are important it is advantageous to use strong carbide formers, then %/Zr+% Hf+% Nb+% Ta should be above 0.1%, preferably 0.3% and even 1.2%. Also % V is good carbide former that tends to form quite fine colonies but has a higher incidence on thermal conductivity than some of the former, but in applications where thermal conductivity should be high but is not required to be extremely high and wear resistance and toughness are both important, it will generally be used with a content above 0.1%, preferably 0.24% and even more than 1.15%. For very high wear resistance applications it can be used with content higher than 4.2% or even 8.2%. Other elements may be present, especially those with little effect on the objective of the present invention. In general it is expected to have less than 2% of other elements (elements not specifically cited), preferably 1%, more preferably 0.45% and even 0.2%.

The steels described above can be particularly interesting for applications requiring a steel with corrosion or oxidation resistance, especially when high levels of mechanical characteristics are desirable and the cost associated to heat treatment (both in terms of time and money) for its execution or associated distortions, are significant According to another embodiment of the present invention the steels can have the following composition, all percentages being indicated in weight percent:

| | | | |
|---|---|---|---|
| % $C_{eq}$ = 0.5 – 3.0 | % C = 0.5 – 3.0 | % N = 0 – 2.2 | % B = 0 – 2.0 |
| % Cr = 0.0 – 14 | % Ni = 0 – 6.0 | % Si = 0 – 2.0 | % Mn = 0 – 3 |
| % Al = 0 – 2.5 | % Mo = 0 – 15 | % W = 0 – 15 | % Ti = 0 – 4 |
| % Ta = 0 – 4 | % Zr = 0 – 12 | % Hf = 0 – 4 | % V = 0 – 12 |
| % Nb = 0 – 4 | % Cu = 0 – 2 | % Co = 0 – 6, | |

the rest consisting of iron and trace elements wherein, $$\% C_{eq} = \% C + 0.86 * \% N + 1.2 * \% B,$$

This composition as such forms an invention without the restrictions of claims 1 and 3.

It should be clear that from all the possible compositions within the range only those are of interest where the microstructure described in the present invention is attainable. Some smaller ranges within the above mentioned compositional range are of special significance for certain applications. For example when it comes to the % Ceq content it is preferably to have a minimum value of 0.62%, preferably 0.83% more preferably 1.04% and when extreme wear resistance is important preferably 1.22%, more preferably 1.46% and even more than 1.64%. Very high levels of % Ceq are interesting due to the low temperature at which martensite transformation starts, such applications favor % Ceq maximum levels of 1.8%, preferably 2.4% and even 2.8%. % Cr has two ranges of particular interest: 3.2%-5.5% and 5.7%-9.4%. To enhance hardness gradient at the secondary hardness peak it is highly recommendable to have % Moeq present in the steel, often more than 2.4%, preferably more than 4.2% and even more than 10.2% offer a significant effect in this sense. Also for applications where wear resistance or thermal conductivity are important it is advantageous to use strong carbide formers, then % Zr+% Hf+% Nb+% Ta should be above 0.1%, preferably 1.3% and even 3.2%. Also % V is good carbide former that tends to form quite fine colonies of very hard carbides, thus when wear resistance and toughness are both important, it will generally be used with a content above 1.2%, preferably 2.24% and even more than 3.15%. For very high wear resistance applications it can be used with content higher than 6.2% or even 10.2%. Other elements may be present, especially those with little effect on the objective of the present invention. In general it is expected to have less than 2% of other elements (elements not specifically cited), preferably 1%, more preferably 0.45% and even 0.2%. It is important for the achievement of the wear resistance to have the presence of carbide formers stronger than iron, specially the more cost effective are more often used in a more extensive way, in particular generally it will be % Cr+% W+% Mo+% V+% Nb+% Zr should be above 4.0%, preferably 6.2%, more preferably 8.3% and even 10.3%.

The steels described above can be particularly interesting for applications requiring a steel with very high wear resistance, especially when high levels of hardness are desirable and the cost associated to heat treatment (both in terms of time and money) for its execution or associated distortions, are significant.

According to another preferred embodiment of the present invention the steel can have the following composition, all percentages being indicated in weight percent:

| | | | |
|---|---|---|---|
| % $C_{eq}$ = 0.2 – 0.9 | % C = 0.2 – 0.9 | % N = 0 – 0.6 | % B = 0 – 0.6 |
| % Cr = 0.0 – 4.0 | % Ni = 0 – 6.0 | % Si = 0.2 – 2.8 | % Mn = 0.2 – 3 |
| % Al = 0 – 2.5 | % Mo = 0 – 6 | % W = 0 – 8 | % Ti = 0 – 2 |
| % Ta = 0 – 2 | % Zr = 0 – 2 | % Hf = 0 – 2 | % V = 0 – 4 |
| % Nb = 0 – 2 | % Cu = 0 – 2 | % Co = 0 – 6, | |

the rest consisting of iron and trace elements wherein, $$\% C_{eq} = \% C + 0.86 * \% N + 1.2 * \% B,$$

characterized in that

% Si+% Mn+% Ni+% Cr>2.0, or
% Mo>1.2, or
% B>2 ppm

This composition as such forms an invention without the restrictions of claims 1 and 3.

It should be clear that from all the possible compositions within the range only those are of interest where the microstructure described in the present invention is attainable. Some smaller ranges within the above mentioned compositional range are of special significance for certain applications. For example when it comes to the % Ceq content it is preferably to have a minimum value of 0.22%, preferably 0.28%, more preferably 3.2% and even 3.6%. Very high levels of % Ceq are interesting due to the low temperature at which martensite transformation starts, such applications favor % Ceq maximum levels of 0.6%, preferably 0.8% and even 0.9%. % Cr has two ranges of particular interest: 0.6%-1.8% and 2.2%-3.4%. Particular embodiments also prefer % Cr to be 2%. To enhance hardness gradient at the secondary hardness peak it is highly recommendable to have % Moeq present in the steel, often more than 0.4%, preferably more than 1.2%, more preferably more than 1.6% and even more than 2.2% offer a significant effect in this sense. In this particular application of the invention the elements that mostly remain in solid solution, the most representative being % Mn, % Si and % Ni are very critical. It is desirable to have the sum of all elements which primarily remain in solid solution exceed 0.8%, preferably exceed 1.2%, more preferably 1.8% and even 2.6%. As can be seen both % Mn and % Si need to be present. % Mn is often present in an amount exceeding 0.4%, preferably 0.6% and even 1.2%. For particular applications, Mn is interesting to be even 1.5%. The case of % Si is even more critical since when present in significant amounts it strongly contributes to the retarding of cementite coarsening. Therefore % Si will often be present in amounts exceeding 0.4%, preferably 0.6% and even 0.8%. When the effect on cementite is pursuit then the contents are even bigger, often exceeding 1.2%, preferably 1.5% and even 1.65%. Also for applications where wear resistance or thermal conductivity are important it is advantageous to use strong carbide formers, then %/Zr+% Hf+% Nb+% Ta should be above 0.1%, preferably 1.3% and even 2.2%. Also % V is good carbide former that tends to form quite fine colonies of very hard carbides, thus when wear resistance and toughness are both important, it will generally be used with a content above 0.2%, preferably 0.4% and even more than 0.8%. For very high wear resistance applications it can be used with content higher than 1.2% or even 2.2%. Other elements may be present, especially those with little effect on the objective of the present invention. In general it is expected to have less than 2% of other elements (elements not specifically cited), preferably 1%, more preferably 0.45% and even 0.2%. As can be seen the critical elements for attaining the mechanical properties desired for such applications need to be present and thus it has to be % Si+% Mn+% Ni+% Cr greater than 2.0%, preferably greater than 2.2%, more preferably greater than 2.6% and even greater than 3.2%. For some applications it is interesting to replace % Cr for % Mo, due to the higher effect on the secondary hardness peak and the improved thermal conductivity potential it impairs the steel, and then the same limits apply. Alternatively to % Si+% Mn+% Ni+% Mo>2.0% . . . the presence of % Mo can be dealt alone when present in an amount exceeding 1.2%, preferably exceeding 1.6%, and even exceeding 2.2%. For the applications where cost is important it is specially advantageous to have the expression % Si+% Mn+% Ni+% Cr replaced by % Si+% Mn and then the same preferential limits can apply, but in presence of other alloying elements, also lower limits can be used like % Si+% Mn>1.1%, preferably 1.4% or even 1.8%. For some applications, % Ni is desirable to be at least 1%. For this kind of steels tough bainite treatments at temperatures close to martensite start of transformation (Ms) are very interesting (often 70% or more, preferably 70% and more, or even 82% or more of the transformation of austenite should take place below 520° C., preferably 440° C., more preferably 410° C. or even 380° C., but not below 50° C. below martensite start of transformation [Ms]). To lower the hardness for machining one or several long tempering cycles around cementite separation and cementite coalescence but below Chromium carbide precipitation (alternatively Molybdenum carbide) can be used. The actual temperature is composition dependent but often between 380 and 460° C.

The steels described above can be also applied for the manufacturing of big plastic injection tools particularly interesting for applications requiring very low cost steel with high mechanical resistance and toughness. This particular application of the present invention is also interesting for other applications requiring inexpensive steels with high toughness and considerable yield strength. It is particularly advantageous when the steel requires a harder surface for the application and the nitriding or coating step is made coincide with the hardening step.

A very interesting aspect of the present invention, leading to significant cost reductions, is given when the amount of machining required in hard state can be minimized or even eliminated. This is so because the machining at high hardness is costly. The present invention allows to do so, given the small amount of deformation associated to some of the below austenitization hardening low temperature heat treatments. Most importantly the deformation is highly reproducible and isotropic for which reason it can be taken into account and compensated for during the machining in softer condition. The composition and heat treatment strategy has to be well chosen for the deformation during the last tranche of the heat treatment to be small enough to avoid machining in hard state, which allows making coincide the sub-austenitization temperature hardening heat treatment to coincide with the nitriding or other superficial treatment. As an illustrative example, for many of the steels of the present invention when % Cr and % Si are low and % Moeq is rather high, and when a bainitic treatment is chosen, normally the material will shrink for low tempering temperatures, expand close for temperatures close to the maximum secondary hardness peak, and shrink again for higher temperatures, thus it is possible if the material is not tempered or just tempered at very low temperatures, to find a temperature above the temperature delivering maximum secondary hardness, which renders almost no net deformation in the last tranche of the heat treatment (compensation of shrinkage with expansion). Thus it is a special execution of the present invention steels that can be delivered with a low enough hardness for massive machining after quenching (with or without tempering) which can suffer very slight, reproducible and isotropic deformation when the final hardness rising part of the heat treatment is applied. Thus the steel will then be characterized by an attainable deformation, in the last sub-austenitization temperature hardening tranche of the heat treatment, smaller than 0.2% preferably smaller than 0.1%, more preferably smaller than 0.05% and even smaller than 0.01%. Also the difference in the deformation in two different directions, isotropy of the deformation, can be made to be higher than a 60%, preferably higher than a 72%, often higher than 86% and even higher than a 98%. When it comes to reproducibility, it is possible with an especial execution of the present invention to attain reproducibility of the deformation in the last tranche of the hardening process above a 60%, preferably above a 78%, often above a 86% and even above a 96%. (Reproducibility measured as the percentage difference of the deformation occurred in one same orientation with two selected identical treatments).

Indeed one main aspect for many of the steels of the present invention is the possibility of easily machining, even in big amounts, in a state that does not require austenitization afterwards to attain the desired working hardness, and this in steels that are not precipitation hardening. Therefore it is important to have a low hardness after the first tranche of the treatment involving austenitization. Normally 48 HRc still allow for quite fast turning, but if form milling is involved the hardness should not exceed 45 HRc and preferably 44 HRc and even be less than 42 HRc. If some more complex operations like honing or screw tapping have to be carried away then it is desirable that the attainable hardness can be even lower than 40 HRc, preferably 38 HRc or even lower than 36 HRc.

The temperatures involved in the last tranche of the heat treatment, which are always below austenitization temperature, play a significant role for some applications. For instance, in some applications it is desirable to have such temperature as high as possible, since those applications benefit either from the tempering resistance or the higher stability associated to a high temperature tempering. Thus for those applications it is desirable to have the ability to attain the working hardness even if temperatures above 600° C., preferably 620° C., more preferably 640° C. and even 660° C. are involved. On the other hand some applications benefit from having the temperature for the last tranche hardening cycle at the common temperatures employed for superficial heat treatments, and especially when an acceptably low deformation or high enough deformation stability occurs with this treatment. Such temperatures are for example 480° C., 500° C. to 540° C. and 560° C.

One way for the steels of the present invention to be able to increase their hardness through a low temperature tempering like thermal treatment, is by assuring that the right type of carbides are present at the moment of delivery of the steel, so that it is desirable that at least 30% vol % of all the carbides, preferably 35% vol % or more, more preferably 42% vol % and even more preferably more than 58% vol % of carbides have at least 50% at %, preferably 55% at %, more preferably 62% at % and even more preferably more than 73% at % iron of all metallic constituents of the carbides. Another possible way is by assuring that at the moment of delivery the steel microstructure presents less than 70% of the alloyed carbides, preferably less than 65%, more preferably less than 58% and even less than 42% of the mentioned alloyed carbides that can be attained (maximum vol % possible) with the chosen composition according to simulation for phase equilibria software packages, like for example Themo-Calc or MTDATA.

The increase in hardness in the last tranche of the heat treatment is mainly attained trough the precipitation of alloy carbides, but can also be a consequence of the transformation of retained austenite. For many compositions in the present invention, a separation of cementite from martensite occurs at temperatures around 450° C. leading to a decrease in hardness often used in the present invention to provide the low hardness machining delivery condition. This point of lowest hardness in the tempering graph can be as low as 300° C. and as high as 540° C. When tempering at higher temperatures in the final tranche of the heat treatment for all possible microstructures in the present invention dissolution of the cementite and the carbon that goes into solid solution can contribute to the separation or further precipitation of alloyed carbides, that is carbides containing carbide forming elements. (Cr, Mo, W, V, Nb, Zr, Ta, Hf . . . ), often mixed carbides containing those elements and others like for example iron. Those carbides often precipitate as M7C3, M4C3, MC, M6C, M2C. The temperature at which this happens is often above 400° C., preferably 450° C., more preferably 480° C. and even 540° C. Another mechanism that is profited from with some compositions of the present invention to contribute to the hardness increase is the decomposition of retained austenite.

Available carbon, i.e. carbon which is not combined with any other element in the form of carbides and which can be found in solid solution or not, as well as the nature of the alloyed carbides will have an effect on the amount of hardness increase once the proper tempering is applied.

It is clear that the present invention is especially advantageous when abundant machining has to be undergone by the steel, and yet high bulk working hardness is desirable. In fact the present invention is particularly advantageous if more than a 10% of the original weight of the steel block has to be removed to attain the final geometry, more advantageous when more than 26% has to be removed, and even more advantageous when more than 54% has to be removed. Most machining will normally take place between the first tranche of the heat treatment involving austenitization and eventual one or more tempering-like cycles and the final tranche of the heat treatment. In fact often at least a 32% of the total machining will occur in this state, often more than 54% of the total machining, even more than 82% of the total machining when not the 100%. In some instances it might be advantageous to perform some machining before the part of the heat treatment involving austenitization, like for example long holes or any other kind of machining especially when it is difficult. And as mentioned before machining in the hard state does happen quite often, but normally in small amounts given its higher cost.

To attain the high levels of hardness and wear resistance sometimes desirable in the present invention, considerably high levels of the volume fraction of hard particles have to be used. The volume fraction of hard particles (carbides, nitrides, borides and mixtures thereof) is often above a 3%, preferably above 4.2%, more preferably above a 5.5%, and for some high wear applications, even above a 8%. Size of primary hard particles is very important to have an effective wear resistance and yet not excessively small toughness. The inventors have observed that for a given volume fraction of hard particles the overall resilience of the material diminishes as the size of the hard particles increases, as would be expected. More surprisingly it has also been observed that when the size of hard particles is increased, the overall fracture toughness increases if the fracture toughness of the particles themselves is maintained. When it comes to abrasive wear resistance it has been observed the existence of a critical hard particle size, below which the hard particle is not effective against the abrasive agent. This critical size depends on the size of the abrasive agent and the normal pressure. For some applications where the abrasive particles are of small size (normally below 20 microns), it can be desirable to have primary hard particles smaller than 10 microns or even smaller than 6 microns, but in any case with an average size not smaller than 1 micron. For applications where big abrasive particles cause the wear, big primary hard particles will be desirable. Therefore, for some applications it is desirable to have some primary hard particles bigger than 12 microns, often greater than 20 microns and for some particular applications even greater than 42 microns.

For applications where mechanical strength more than wear resistance are important, and it is desirable to attain such mechanical strength without compromising too much toughness, the volume fraction of small secondary hard particles is of great importance. The term "small secondary hard particles" as used in the application are those with a maximum equivalent diameter (diameter of a circle with equivalent surface as the cross section with maximum surface on the hard particle) below 7.5 nm. It is desirable to have a volume fraction of small secondary hard particles for such applications above 0.5%. It is believed that a saturation of mechanical properties for hot work applications occurs at around 0.6%, but it has been observed by the inventors that for some applications requiring high plastic deformation resistance at somewhat lower temperatures it is advantageous to have higher amounts than 0.6%, often more than 0.8% and even more than 0.94%. Since the morphology (including size) and volume fraction of secondary carbides change with heat treatment, the values presented here describe attainable values with proper heat treatment.

In view of the preceding paragraphs, an effort can be made to try to group all possible compositions of steels where the present invention is of especial interest. Of course, of all the possible compositions within the range only those where the microstructure described in the present invention is attainable are of interest. The result is that the steel would have the following compositional restrictions:

% Ni<1% or
% Cr>4% or
% C>=0.33% or
% Mo>2.5% or
% Al<0.6% or
at least one of W, Zr, Ta, Hf, Nb, La, Ac is >=0.01% or
at least one of S, P, Bi, Se, Te is >=0.01%

While for some steels of the present invention large quantities of % Ni are desirable, for others the content has to be low enough for the present invention to work, in combination with the other alternative compositional restrictions % Ni<1% is a valid limit, one would have preferably % Ni<0.8 or even % Ni<0.2. Also for % Cr it has been mentioned that the high thermal conductivity steels will have low % Cr contents, often below 3% and even below 0.1%, but their compositions get covered by other alternatives in this composition, like % Mo>2.5% or % Al<0.6%, also for the ones presenting high wear resistance % C>=0.33%. But for ambient resistant steels it has to be % Cr>4%. In fact in this global compositional restriction it is also preferably to have % Cr>5.3% and even % Cr>7.2%. It is also preferably to have % Mo>3.2% and even better to have a restriction involving % Moeq instead of % Mo like % Moeq>2.8% or preferably % Moeq>3.4 or even % Moeq>4.2%. Another interesting case is that of % A, where it would be preferably to have % Al<0.4 or even % Al<0.16, and it would also be interesting to combine with % Si since both are aiming at a similar goal, namely the reduction of the negative influence of Fe3C morphology on toughness. In this respect one could have the additional restriction with the % Al restriction of % Si<0.8, preferably % Si<0.4 and even % Si<0.2. In the case of carbon, it would be preferably to have % C>0.36 or even % C>0.42. It could also be possible, even convenient to make the restriction in terms of carbon equivalent instead. So one would have % Ceq>=0.33, preferably % Ceq>=0.36 or even % Ceq>0.46. In the case of the selected strong carbide formers (W, Zr, Ta, Hf, Nb, La, Ac) one would have preferably more than 0.08% or even more than 0.16%. At last the case of vanadium should be mentioned, since this element should in principle add two additional disjunctive restrictions, one to limit its presence to care for high thermal conductivity steels without high wear resistance where it would be % V<1, preferably % V<0.4 and even % V<0.2. And even more important, for applications requiring high wear resistance we should have % V>0.3, preferably % V>1.2 or even % V>3.2.

To increase machinability, S, As, Te, Bi or even Pb, Ca, Cu, Se, Sb or others can be used, with a maximum content of 1%, with the exception of Cu that can even have a maximum content of 2%. The most common substance, sulfur, has, in comparison, a light negative effect on the matrix thermal conductivity in the normally used levels to increase machinability. However, its presence must be balanced with Mn, in an attempt to have everything in the form of spherical manganese bisulphide, less detrimental for toughness, as well as the least possible amount of the remaining two elements in solid solution in case that thermal conductivity needs to be maximized. Other elements may be present, especially those with little effect on the objective of the present invention. In general it is expected to have less than 2% of other elements (elements not specifically cited), preferably less than 1%, and most preferably less than 0.45% and even less than 0.2%.

The steel of the present invention can be manufactured with any metallurgical process, among which the most common are sand casting, lost wax casting, continuous casting, melting in electric furnace, vacuum induction melting. Powder metallurgy processes can also be used along with any type of atomization and eventually subsequent compacting as the HIP, CIP, cold or hot pressing, sintering (with or without a liquid phase and regardless of the way the sintering process takes place, whether simultaneously in the whole material, layer by layer or localized), laser cusing, spray forming, thermal spray or heat coating, cold spray to name a few of them. The alloy can be directly obtained with the desired shape or can be improved by other metallurgical processes. Any refining metallurgical process can be applied, like VD, ESR, AOD, VAR . . . . Forging or rolling are frequently used to increase toughness, even three-dimensional forging of blocks. Tool steel of the present invention can be obtained in any shape, for example in the form of bar, wire or powder (amongst others to be used as solder or welding alloy). Also laser, plasma or electron beam welding can be conducted using powder or wire made of steel of the present invention. The steel of the present invention could also be used with a thermal spraying technique to apply in parts of the surface of another material. Obviously the steel of the present invention can be used as part of a composite material, for example when embedded as a separate phase, or obtained as one of the phases in a multiphase material. Also when used as a matrix in which other phases or particles are embedded whatever the method of conducting the mixture (for instance, mechanical mixing, attrition, projection with two or more hoppers of different materials . . . ). The steels of the present invention can also be a part of a functionally graded material, in this sense any protective layer or localized treatments can be used. The most typical ones being layers or surface treatments:

To improve tribological performance: Superficial hardening (laser, induction . . . ), superficial treatment (nitriding, carburizing, borurizing, sulfidizing, any mixtures of the previous . . . ), coatings (CVD, PVD, fluidized bed, thermal projection, cold spray, cladding . . . ).

To increase corrosion resistance: hard chromium, palladium, chemical Nickel treatment, sol gel with corrosion resistant resins, in fact any electrolytic or non-electrolytic treatment providing corrosion or oxidation protection.

Any other functional layer also when the function is appearance.

Tool steel of the present invention can also be used for the manufacturing of parts requiring a high working hardness (for example due to high mechanical loading or wear) which require some kind of shape transformation from the original steel format. As an example: Dies for forging (open or closed die), extrusion, rolling. The present invention is especially indicated for the manufacture of dies for the hot stamping or hot pressing f sheets. Dies for plastic forming of thermoplastics and thermosets in all of its forms. Also dies for forming or cutting.

EXAMPLES

Some examples indicate the way in which the steel composition of the invention can be specified with higher precision for different hot working applications:

Example 1

High Thermal conductivity steels (over 42 W/mK and over 8.5 mm2/s and reaching 57 W/mK and 13.5 mm2/s at 50 HRc, the thermal conductivity and diffusivity increase for lower hardnesses at least until 40 HRc for all steels of the present example), delivered at a hardness of 45 HRc or less and then raising the hardness to above 48 HRc after a great part of the machining has taken place.

For this purpose in the context of the present invention the following compositional range can be used:

$C_{eq}$: 0.3-0.6 Cr<3.0% (preferably Cr<0.1%)

V: 0-0.9%

Si: <0.15% (preferably % Si<0.1, but with an acceptable level of oxide inclusions)

Mn: <1.0% $Mo_{eq}$: 2.0-8.0 where $Mo_{eq}$=% Mo+½% W and $C_{eq}$=% C+0.86*% N+1.2*% B

The rest of the elements should be kept as low as possible and, in any case, always be below 0.45%, with the exception of carbide formers stronger than tungsten (% Ta, % Zr, % Hf . . . ), and some solid solution strengtheners like % Ni, % Co and eventually % Cu.

All values are given in weight percentage.

The following examples show properties that can be obtained:

| % C | % Mo | % W | % V | % Cr | % Si | % Mn | Other | Delivery Hardness HRc | Max usage hardness HRc |
|---|---|---|---|---|---|---|---|---|---|
| 0.40 | 3.6 | 1.4 | 0.3 | <0.01 | <0.05 | <0.01 | — | 39* | 56 |
| 0.32 | 3.36 | 1.91 | 0.22 | <0.01 | <0.05 | 0.4 | Hf, Zr, Nb, B | 41* | 53 |
| 0.33 | 3.8 | 1.22 | 0.4 | <0.01 | <0.05 | <0.01 | Hf, Zr, Nb | 40* | 53 |
| 0.36 | 3.66 | 1.26 | 0.02 | <0.01 | <0.05 | <0.01 | Zr = 0.5 | 37** | 52 |
| 0.31 | 3.36 | 1.52 | 0.45 | <0.01 | <0.05 | <0.01 | Hf, Zr, Nb, Co | 40* | 54 |
| 0.36 | 3.75 | 1.91 | 0.44 | 1.12 | 0.1 | 0.47 | Hf, Zr, Nb, Co | 40* | 55 |

-continued

| % C | % Mo | % W | % V | % Cr | % Si | % Mn | Other | Delivery Hardness HRc | Max usage hardness HRc |
|---|---|---|---|---|---|---|---|---|---|
| 0.32 | 3.36 | 1.11 | <0.01 | <0.01 | <0.05 | <0.01 | Hf, Zr, | 38* | 51 |
| 0.60 | 3.6 | 1.2 | 0.62 | <0.01 | 0.14 | 0.54 | — | 44* | 58 |
| 0.72 | 3.75 | 2.0 | 0.54 | <0.01 | <0.05 | <0.01 | Hf, Zr, Ni, Co, B | 45* | 52 |
| 0.34 | 1.6 | 4.5 | 0.1 | <0.01 | <0.05 | <0.01 | Ni 2.6 | 38** | 52 |
| 0.31 | 3.2 | 0.8 | <0.01 | <0.01 | <0.05 | <0.01 | Ni 0.8 | 37** | 50 |
| 0.31 | 3.2 | 0.8 | <0.01 | <0.01 | <0.05 | <0.01 | Ni 0.8 | 4-7*** | 52 |

*Delivery takes place with a mixed bainite/martensite microstructure where at least one tempering below 550° C. has been applied.
**Delivery takes place with a mostly bainitic microstructure for heavy sections and either no tempering or one or more tempering cycles under 580° C. have been applied.
***Delivery takes place with a martensitic microstructure where either no tempering or one or more tempering cycles under 580° C. have been applied.

Other Examples

| % C | % Mo | % W | % V | % Cr | % Si | % Mn | Other | Delivery Hardness HRc | Max usage Hardness HRc |
|---|---|---|---|---|---|---|---|---|---|
| 0.17 | 3.3 | 1.1 | 0.10 | <0.01 | 0.2 | 0.36 | Hf, Zr, Co | 39* | 50 |
| 0.65 | 2.0 | <0.01 | <0.01 | 17 | 0.4 | 0.3 | | 44*** | 51 |
| 1.23 | 3.8 | 11.2 | 3.4 | 2.01 | <0.05 | 0.21 | Co | 47** | 62 |
| 0.98 | 2.66 | 1.26 | 2.02 | 8.01 | 1.05 | 0.17 | | 47** | 58 |
| 0.45 | 3.39 | 1.54 | 0.85 | 4.21 | 0.25 | 0.41 | | 40* | 51 |
| 0.61 | 3.34 | 1.65 | 0.52 | 5.08 | 0.32 | 0.32 | Hf, Zr, Nb | 44* | 57 |

*Delivery takes place with a mixed bainite/martensite microstructure where at least one tempering below 550° C. has been applied.
**Delivery takes place with a mostly bainitic microstructure for heavy sections and either no tempering or one or more tempering cycles under 580° C. have been applied.
***Delivery takes place with a martensitic microstructure with some perlite isles where either no tempering or one or more tempering cycles under 580° C. have been applied.

Other Examples

| % C | % Mo | % W | % V | % Cr | % Si | % Mn | Other * | Delivery Hardness HRc | Max usage Hardness HRc |
|---|---|---|---|---|---|---|---|---|---|
| 0.29 | 3.36 | 0.1 | 0.002 | 0.019 | 0.04 | 0.022 | — | 40 | 51 |
| 0.28 | 3.59 | 0.6 | 0.003 | 0.02 | 0.04 | 0.025 | — | 40.5 | 53 |
| 0.28 | 3.70 | 1.19 | <0.005 | 0.01 | 0.04 | 0.02 | — | 38 | 49.5 |
| 0.39 | 3.71 | 1.2 | 0.6 | 0.01 | 0.05 | 0.02 | Ni 0.84, Hf, Nb, Zr | 42 | 53.5 |
| 0.41 | 3.63 | 1.63 | 0.81 | 0.01 | 0.04 | 0.02 | Co 3.00 | 42.5 | 57 |
| 0.4 | 1.15 | 0.02 | 0.87 | 8.2 | 0.11 | 0.14 | Ni, Al, Co | 43 | 56 |
| 0.27 | 3.40 | 1.08 | <0.005 | 0.01 | 0.05 | 0.02 | Hf | 42 | 54 |
| 0.29 | 3.70 | 1.01 | 0.005 | 0.01 | 0.05 | 0.019 | — | 42 | 53 |
| 0.33 | 3.39 | 1.11 | 0.43 | 0.01 | 0.05 | 0.24 | Nb | 42 | 54 |
| 0.32 | 3.36 | 1.15 | 0.44 | 0.01 | 0.05 | 0.12 | Ni 2.04 | 338HB | 53 |
| 0.29 | 3.62 | 1.18 | 0.004 | 0.01 | 0.05 | 0.02 | — | 40 | 53 |
| 0.33 | 3.58 | 1.27 | <0.005 | 0.01 | 0.05 | 0.14 | Ni 3.09 | 41 | 53 |
| 0.41 | 3.58 | 1.16 | 0.65 | 0.01 | 0.07 | 0.14 | Nb | 43 | 54 |
| 0.33 | 3.64 | 1.1 | 0.46 | 0.01 | 0.05 | 0.26 | Nb | 41 | 55 |
| 0.33 | 3.7 | 1.36 | 0.43 | 0.01 | 0.05 | 0.26 | Nb, Zr | 42/40 | 54/53.5 |
| 0.21 | 3.2 | 1.04 | 0.3 | 0.01 | 0.04 | 0.21 | — | 42 | 50 |
| 0.31 | 3.70 | 2.3 | <0.005 | 0.01 | 0.02 | 0.02 | Ni 1.86 | 41 | 50 |
| 0.37 | 3.90 | 2.0 | <0.005 | 0.01 | 0.02 | 0.11 | Ni 2.05 | 39 | 48.5 |
| 0.44 | 3.64 | 1.97 | 0.7 | 0.01 | 0.05 | 0.02 | Co 3.00 | 45 | 56 |
| 0.43 | 3.73 | 1.8 | 0.69 | 0.01 | 0.05 | 0.02 | Co 3.00 | 44 | 57 |
| 0.32 | 3.10 | 1.68 | <0.005 | 0.01 | 0.04 | 0.09 | Ni 2.96 | 38 | 52 |

-continued

| % C | % Mo | % W | % V | % Cr | % Si | % Mn | Other * | Delivery Hardness HRc | Max usage Hardness HRc |
|---|---|---|---|---|---|---|---|---|---|
| 0.29 | 3.60 | 1.09 | <0.005 | 0.01 | 0.03 | 0.015 | Hf, B, Zr | 42 | 47 |
| 0.39 | 3.57 | 1.35 | 0.44 | <0.01 | <0.01 | <0.01 | Hf, Zr, Nb | 43 | 53 |
| 0.32 | 3.1 | 1.7 | 0.030 | 0.1 | 0.1 | 0.17 | Ni 0.017 | 40 | 50 |
| 0.356 | 3.900 | 1.400 | 0.484 | <0.01 | <0.05 | 0.058 | Ni 0.470 | 43 | 51 |
| 0.353 | 3.810 | 1.410 | 0.461 | <0.01 | <0.05 | 0.061 | Ni 0.481 | 137HB | 53.5 |
| 0.326 | 3.680 | 1.490 | 0.440 | 0.0108 | <0.05 | 0.055 | Ni 0.488 | 40 | 57.5 |
| 0.464 | 3.890 | 1.670 | 0.452 | <0.01 | <0.05 | 0.055 | Ni 0.516 | 382HB | 54.5 |
| 0.299 | 3.770 | 1.310 | 0.452 | <0.01 | <0.05 | 0.051 | Ni 0.950 | 42 | 53 |
| 0.404 | 3.800 | 2.460 | 0.457 | <0.01 | <0.05 | 0.061 | Ni 0.969 | 328HB | 51.5 |
| 0.377 | 3.810 | 1.350 | 0.473 | <0.01 | <0.05 | 0.059 | Ni 1.010 | 43 | 56 |
| 0.345 | 3.890 | 1.640 | 0.470 | 0.012 | <0.05 | 0.054 | Ni 1.410 | 42 | 56 |
| 0.336 | 3.770 | 1.580 | 0.462 | <0.01 | <0.05 | 0.055 | Ni 1.580 | 42 | 55 |
| 0.409 | 3.750 | 1.360 | 0.451 | <0.01 | <0.05 | 0.060 | Ni 1.620 | 44 | 54.5 |
| 0.371 | 3.730 | 1.510 | 0.457 | <0.01 | <0.05 | 0.060 | Ni 2.000 | 46 | 58 |
| 0.467 | 3.660 | 2.000 | 0.448 | <0.01 | <0.05 | 0.062 | Ni 2.120 | 45 | 55 |
| 0.36 | 3.7-4 | 2.2 | <0.001 | <0.02 | <0.05 | 1.12 | Ni 2.15 | 43.5 | 54 |
| 0.401 | 3.670 | 1.690 | 0.450 | <0.01 | <0.05 | 0.062 | Ni 2.560 | 395HB | 53 |
| 0.367 | 3.660 | 1.460 | 0.463 | <0.01 | <0.05 | 0.060 | Ni 2.580 | 44 | 58 |
| 0.403 | 3.030 | 1.930 | 0.016 | 0.066 | <0.05 | 0.145 | Ni 2.840 | 44 | 56 |
| 0.336 | 3.040 | 1.930 | 0.012 | 0.061 | 0.103 | 0.149 | Ni 2.870 | 40 | 51 |
| 0.240 | 2.920 | 1.970 | 0.017 | 0.091 | 0.085 | 0.160 | Ni 2.98 | — | — |
| 0.383 | 3.35 | 1.92 | <0.001 | 0.0327 | 0.119 | 0.117 | Ni 2.98 | 42 | 53 |
| 0.350 | 3.020 | 2.070 | 0.018 | 0.094 | 0.080 | 0.150 | Ni 2.99 | 41 | 52 |
| 0.32 | 2.81 | 2.10 | 0.080 | 0.120 | 0.000 | 0.210 | Cu, Ni 3.00 | 42.5 | 50 |
| 0.322 | 3.010 | 1.930 | 0.017 | 0.071 | <0.05 | 0.144 | Ni 3.010 | 38 | 50 |
| 0.32 | 3.13 | 1.9 | 0.030 | 0.07 | 0.13 | 0.17 | Ni 3.04 | 39 | 50 |
| 0.340 | 3.100 | 1.990 | 0.016 | 0.120 | <0.05 | 0.135 | Ni 3.07 | 40 | 51 |
| 0.371 | 3.660 | 1.390 | 0.465 | <0.01 | <0.05 | 0.066 | Ni 3.070 | 409HB | 55 |
| 0.402 | 3.060 | 2.100 | 0.020 | 0.085 | <0.05 | 0.166 | Ni 3.08 | 43 | 50 |
| 0.384 | 3.080 | 2.130 | 0.016 | 0.074 | 0.088 | 0.158 | Ni 3.08 | 338HB | 49 |
| 0.32 | 2.92 | 1.75 | 0.030 | 0.1 | 0.14 | 0.16 | Ni 3.1 | 40 | 49.5 |
| 0.384 | 3.090 | 2.080 | 0.019 | 0.079 | 0.104 | 0.168 | Ni 3.11 | 348HB | 48 |
| 0.392 | 3.670 | 1.500 | 0.459 | <0.01 | <0.05 | 0.070 | Ni 3.190 | 44 | 58 |
| 0.240 | 3.20 | 2.39 | 0.050 | 0.070 | 0.010 | 0.240 | Ni 3.21 | 38 | 49.5 |
| 0.392 | 3.63 | 2.52 | 0.0216 | 0.0832 | 0.0958 | 0.213 | Ni 3.73 | 40.5 | 51 |
| 0.8 | 0.25 | <0.01 | 0 | <0.01 | 1.59 | 1.98 | — | 40** | 50 |
| 1.4 | 0.25 | <0.01 | 3.0 | <0.01 | 1.59 | 1.98 | — | 39.5** | 49 |
| 0.8 | 0.25 | <0.01 | 2.4 | <0.01 | 1.59 | 1.98 | — | 42** | 48.5 |
| 0.388 | 0.05 | <0.01 | 0.04 | <0.01 | 1.5 | 1.56 | Ni 0.06 | 320HB** | 48 |
| 0.391 | 0.1 | <0.01 | 0.03 | 0.04 | 1.62 | 1.61 | Ni 1.15 | 43** | 49 |
| 0.388 | 0.09 | <0.01 | 0.05 | 2.08 | 1.43 | 1.53 | Ni 0.07 | 42** | 49 |
| 0.388 | 0.05 | <0.01 | 0.02 | 0.01 | 1.52 | 1.61 | Ni 0.05 | 40.5** | 49 |

* Elements specified as other are present, otherwise indicated, in an amount of less than 2%

**For these specific compositions, CVN was found to be >40 J

The invention claimed is:

1. A steel comprising a bainitic and interstitial martensitic microstructure, comprising retained austenite, and/or carbide formers stronger than iron, which are present in the solid solution comprising a composition wherein all percentages are indicated in weight percent, wherein the composition comprises

| | | | |
|---|---|---|---|
| %Ceq = 0.16-1.9 | %C = 0.16-1.9 | %N = 0-1.0 | %B = 0-0.6 |
| %Cr < 1.8 | %Ni = 0-6 | %Si = 0-1.4 | %Mn = 0-3 |
| %Al = 0-2.5 | %Mo = 0-10 | %W = 0-10 | %Ti = 0-2 |
| %Ta = 0-3 | %Zr = 0-3 | %Hf = 0-3 | %V = 0-4 |
| %Nb = 0-1.5 | %Cu = 0-2 | %Co = 0-6, | |

and iron and trace elements, wherein

% Ceq=% C+0.86*% N+1.2*% B, characterized in that

% Mo+½·% W>2.0 wherein the microstructure comprises less than 18% ferrite, and characterized by a low scattering structure characterized by a thermal diffusivity higher than 8 $mm^2/s$.

2. The steel according to claim 1, wherein the microstructure comprises of at least 50% vol. bainite.

3. The steel according to claim 1, wherein the microstructure comprises at least a 50 vol. % interstitial martensite, and retained austenite is present in 2.5-50% vol., and carbide formers stronger than iron are present in 2% weight or more in solid solution.

4. The steel according to claim 1, wherein the microstructure comprises at least 50 vol. % interstitial martensite and retained austenite is present in less than 2.5% vol., and carbide formers stronger than iron are present in 3% weight or more in solid solution.

5. The steel according to claim 1, wherein the bainite is at least 50% high temperature bainite.

6. The steel according to claim 1, wherein the steel has a carbon content, wherein at least 8% of the carbon content thereof is present in the form of carbides not belonging to the bainitic and/or interstitial martensitic microstructure.

7. The steel according to claim 1, wherein the steel comprises carbides, wherein at least 30% vol. of the carbides have 50 at % or more iron of all metallic constituents of the carbide.

8. The steel according to claim 1, wherein the bainite or interstitial martensite present comprises tempered bainite or tempered interstitial martensite.

9. The steel according to claim 1, characterized in that the sum of the amounts of those elements having an affinity for carbon higher than iron selected from the group consisting of Cr, W, Mo, V, Ti, Nb, Ta, Zr, and Hf is more than 4% in weight.

10. The steel according to claim 1, characterized in that the microstructure comprises less than 70% of alloyed carbides that can be attained with the chosen composition.

11. The steel according to claim 1, characterized in that according to a tempering graph of the steel, the martensite and/or bainite present a tempering degree which is smaller than that corresponding to a secondary hardness peak, and a hardness of the steel is below a hardness level of the secondary hardness peak of the steel in an amount of at least 4 HRc.

12. The steel according to claim 1, characterized in that the martensite and/or bainite present comprise less than a 80% of a nominal % C of the steel.

13. The steel according to claim 1, characterized in that the martensite and/or bainite present comprise less than a 80% of a nominal % C of the steel in an untempered state.

14. The steel according to claim 5, wherein the bainite is at least 50% tough high temperature bainite.

15. A steel comprising a bainitic and interstitial martensitic microstructure, comprising retained austenite, and/or carbide formers stronger than iron, which are present in the solid solution comprising a composition wherein all percentages are being indicated in weight percent, wherein the composition comprises:

| | | | |
|---|---|---|---|
| %Ceq = 0.16-1.9 | %C = 0.16-1.9 | %N = 0-1.0 | %B = 0-0.6 |
| %Cr < 1.8 | %Ni = 0-6 | %Si = 0-1.4 | %Mn = 0-3 |
| %Al = 0-2.5 | %Mo = 0-10 | %W = 0-10 | %Ti = 0-2 |
| %Ta = 0-3 | %Zr = 0-3 | %Hf = 0-3 | %V = 0-4 |
| %Nb = 0-1.5 | %Cu = 0-2 | %Co = 0-6, | |

wherein at least one of the elements selected from the group consisting of Zr, Hf, Nb, and Ta is present in an amount greater than 0.1%, and the rest comprises iron and trace elements, and wherein % Ceq=% C+0.86*% N+1.2*% B, characterized in that % Mo+½·% W>2.0 wherein the microstructure comprises less than 18% ferrite, and characterized by a low scattering structure characterized by a thermal diffusivity higher than 8 $mm^2/s$.

16. The steel according to claim 15, wherein the microstructure comprises at least 50% vol. bainite.

17. The steel according to claim 15, wherein the microstructure comprises at least 50 vol. % interstitial martensite, and retained austenite is present in less than 2.5-50% vol., and carbide formers stronger than iron are present in 2% weight or more in solid solution.

18. The steel according to claim 15, wherein the microstructure comprises at least 50 vol. % interstitial martensite and retained austenite is present in less than 2.5% vol., and carbide formers stronger than iron are present in 3% weight or more in solid solution.

19. A steel comprising a bainitic microstructure, comprising retained austenite, and/or carbide formers stronger than iron, which are present in the solid solution comprising a composition wherein all percentages are indicated in weight percent, wherein the composition comprises

| | | | |
|---|---|---|---|
| %Ceq = 0.16-1.9 | %C = 0.16-1.9 | %N = 0-1.0 | %B = 0-0.6 |
| %Cr < 1.8 | %Ni = 0-6 | %Si = 0-1.4 | %Mn = 0-3 |
| %Al = 0-2.5 | %Mo = 0-10 | %W = 0-10 | %Ti = 0-2 |
| %Ta = 0-3 | %Zr = 0-3 | %Hf = 0-3 | %V = 0-4 |
| %Nb = 0-1.5 | %Cu = 0-2 | %Co = 0-6, | |

and iron and trace elements, wherein

% Ceq=% C+0.86*% N+1.2*% B, characterized in that

% Mo+½·% W>2.0 wherein the microstructure comprises at least 50% bainite, and wherein the steel is characterized by a low scattering structure characterized by a thermal diffusivity higher than 8 $mm^2/s$.

20. The steel according to claim 19 wherein the microstructure comprises less than 18% ferrite.

* * * * *